United States Patent [19]

Albright et al.

[11] 3,999,682

[45] Dec. 28, 1976

[54] FILLER ASSEMBLY FOR HELICAL COIL VENDING MACHINES

[75] Inventors: Henry J. Albright, West Des Moines; Arthur N. Wirstlin, Altoona, both of Iowa

[73] Assignee: Fawn Engineering Corporation, Des Moines, Iowa

[22] Filed: Jan. 30, 1975

[21] Appl. No.: 545,590

[52] U.S. Cl. ..... 221/75; 221/241

[51] Int. Cl.[2] ..... G07F 11/46

[58] Field of Search ..... 221/75, 241–242

[56] References Cited

UNITED STATES PATENTS

| | | | |
|---|---|---|---|
| 3,335,907 | 8/1967 | Holstein et al. | 221/75 X |
| 3,591,045 | 7/1971 | Sturrock | 221/75 |
| 3,601,281 | 8/1971 | Schlaf | 221/75 |
| 3,861,561 | 1/1975 | Wittern et al. | 221/75 |
| 3,908,858 | 9/1975 | Wirstlin et al. | 221/75 |

*Primary Examiner*—Robert B. Reeves
*Assistant Examiner*—Charles A. Marmor
*Attorney, Agent, or Firm*—Henderson, Strom & Sturm

[57] ABSTRACT

A plurality of item discharge units disposed in side-by-side fashion within a vending machine, each unit including a tray with a selectively driven helix rotatably disposed therein. A divider member is mounted completely within the helix and extends along the length of the helix and upon the divider member and extends downwardly and at an angle therefrom on both sides of the divider to form spaces triangular in cross section between the divider and the walls of the tray.

5 Claims, 7 Drawing Figures

FILLER ASSEMBLY FOR HELICAL COIL VENDING MACHINES

BACKGROUND OF THE INVENTION

This invention relates to vending machines which use a helical coil to advance an item from a position of storage within the cabinet of the vending machine to a discharge chute, the consumer receiving the item through the discharge chute. U.S. Pat. Nos. 3,203,589; 3,441,174; 3,591,045 and 3,601,281 disclose different vending machines of this type. These vending machines have discharge chutes, mounted either at the front or the side of the cabinet of the machine, and several item discharge units mounted in side-by-side relationship normal to the discharge chute. The units each have a helical coil which rotates to advance the items to be vended. Most of the units have a tray within which the helical coil is disposed.

For reasons of economy, a manufacturer of helical coil vending machines must make all item discharge units of the same construction and of a standard size. The size most commonly chosen is that which will accommodate standard-sized cigarette packages. Such units normally have one dimension which is approximately twice the width, or horizontal dimension, of a standard package of cigarettes and have a divider within and extending the length of the helix to split the unit in half so that two packages may be carried in a side-by-side but separated fashion. Since, however, consumers demand a wide range of products ranging from cigarettes having a large package size to little cigars, gum, mints and lifesavers having smaller package sizes, the manufacturer, to make his machine competitive, must somehow develop a way to adapt his machine to the vending of smaller packaged items.

SUMMARY OF THE INVENTION

According to this invention a filler assembly is provided for helical coil vending machines which normally vend standard-sized cigarette packages. The filler assembly adapts the vending machine to different types of items by filling the space within the helix of the machine.

The invention includes a filler assembly having a top member with a front member affixed thereto. The top member has two sides which join along a ridge, the ridge portion of the top member resting upon the divider passing through the helix. The helix rests upon the top member and passes through the front member. The sides of the top member extend downwardly from the ridge and on opposite sides of the divider and extend at an angle toward the walls of the tray of the discharge unit.

It is an object of this invention to provide an improvement for item discharge units of helical coil vending machines.

It is a further object of this invention to provide an improvement simplified in structure and method of manufacture which will adapt item discharge units built of a standard size to vend items of smaller shapes and sizes.

More particularly it is an object of this invention to provide an improvement which will adapt helical coil vending machines for cigarette packages to the vending of gum, mint and lifesaver packages.

Still another object of this invention is to provide an improvement which will facilitate the loading of smaller than standard-sized packages into the helix and will result in the storage of such items in the most compact manner.

These objects and other features and advantages of this invention will be readily apparent upon reference to the following description and accompanying drawings.

BRIEF DESCRIPTION OF THE DRAWINGS

The appended drawings illustrate the invention, wherein.

DESCRIPTION OF THE PREFERRED EMBODIMENT

Figure 1:
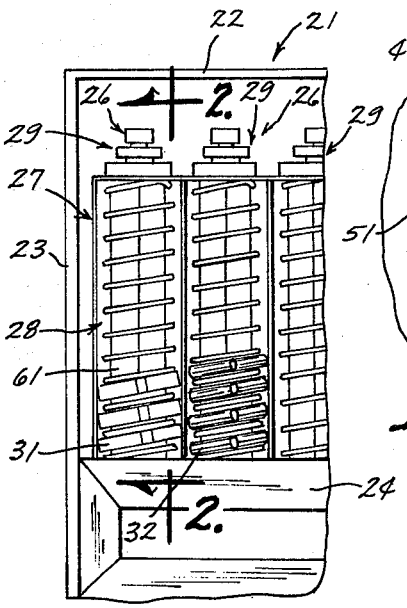
FIG. 1 is a fragmentary, top plan view showing the invention generally in use with the item discharge units of a helical coil vending machine.
Figure 2:
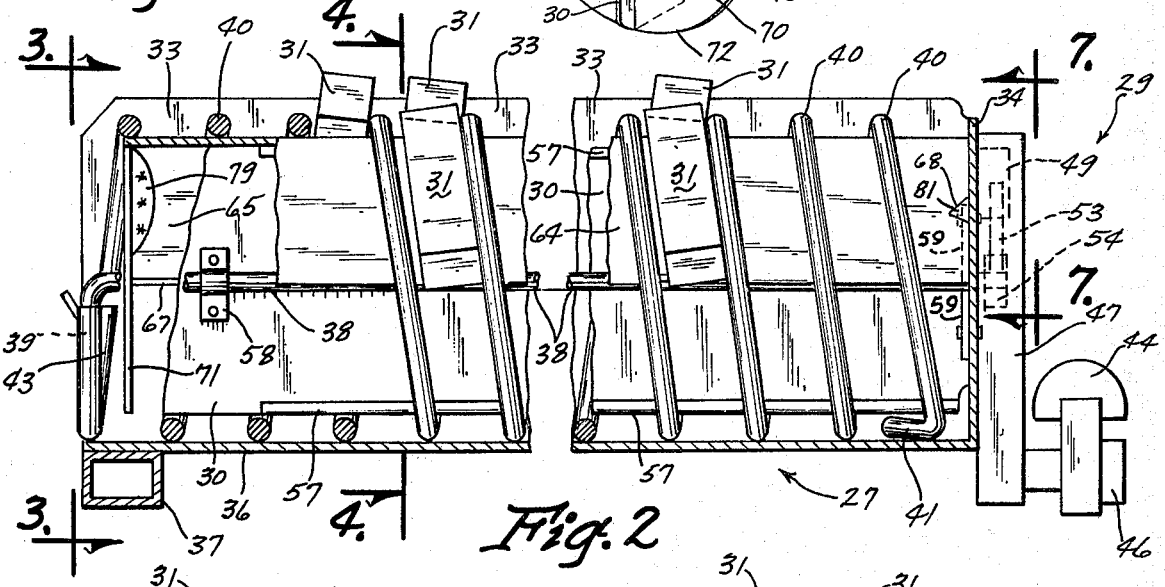
FIG. 2 is an enlarged, foreshortened longitudinal section taken along line 2—2 of FIG. 1, with some parts cut away for greater clarity.
Figure 3:
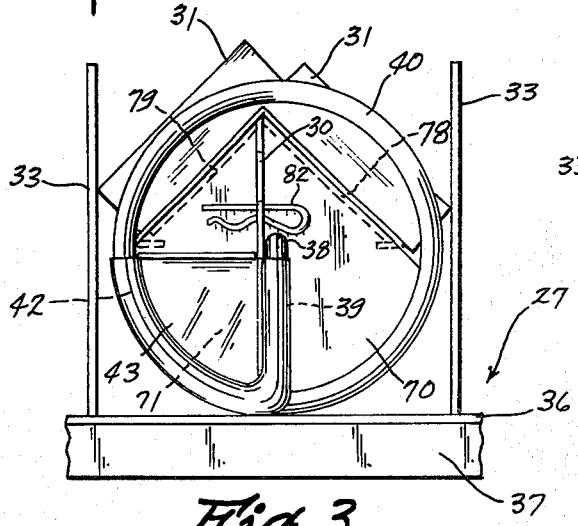
FIG. 3 is an end elevational view taken along the line 3—3 of FIG. 2.
Figure 4:
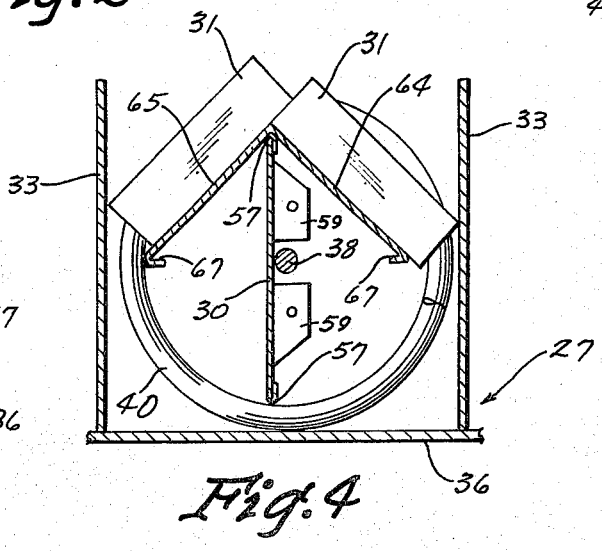
FIG. 4 is a cross-sectional view taken along line 4—4 of FIG. 2.

Referring now to the drawings, a portion of a helical coil vending machine is indicated generally at 21 in FIG. 1. The vending machine 21 has a rear cabinet wall 22 and a side cabinet wall 23. The item discharge chute 24 is mounted in the front part of the vending machine 21. The individual item discharge units 26 are mounted in the vending machine 21 in a side-by-side horizontally disposed fashion parallel to the side cabinet wall 23. The discharge units 26 are mounted perpendicular to and intermediate of the rear cabinet wall 22 and the discharge chute 24. Each discharge unit 26 includes a tray 27, a helix member 28, a drive device 29 and a central divider plate 30 (FIGS. 2,3 and 4). Items depicted in the discharge units 26 are packages of gum 31 and of mints 32.

The tray 27 of each discharge unit 26 includes a pair of parallel side walls 33 (FIGS. 3 and 4) which are shared with adjacent trays 17, as is shown in FIG. 1. The side walls 33 are separated a distance slightly greater than twice the width of a standard-sized cigarette package. An end wall 34 (FIG. 2) is affixed perpendicular to the side walls 33 at the end proximate the rear cabinet wall 22. The walls 33, 34 are affixed perpendicularly to the base 36 of the tray 17. The base 36 is supported at the end adjacent the discharge chute 24 by a front support member 37 and at the opposite end by the drive device 29.

The helix member 28 (FIGS. 1 and 2) of each discharge unit 26 is a unitary structure and includes a drive rod 38 which is coupled at one end to the drive device 29. The rod 38 extends forwardly of the drive device 29, extending through the end wall 34 and passing centrally through the space enclosed by the helix 28. The rod 38 at its forward end forms into a leading radial element 39 normal to the rod 38. In turn, the element 39 forms into a series of convolutions 40 enclosing the drive rod 38. The last convolution 40 terminates in a rear element 41 near the end wall 34. Each convolution has a diameter slightly less than the height of a standard size cigarette package. The most forward convolution has a first quarter portion 42 over which an ejector member 43 is affixed. The ejector member 43 is also affixed over the leading radial element 39 and is substantially triangular in shape.

The drive device 29 of each unit 26 (FIGS. 2 and 7) is affixed to the end wall 33 and extends between the unit 26 and the rear cabinet wall 22. A stand coin-mechanism with appropriate circuitry (not shown) actuates the drive device 29. The drive device 29 has an electric motor 44 which operates a gear reduction unit 46. The drive rod 38 of the helix 28 is coupled to the gear reduction unit 46. A housing 47, affixed to the end wall 34, covers part of the unit 46 and also the switch mechanism 48.

Figure 7:
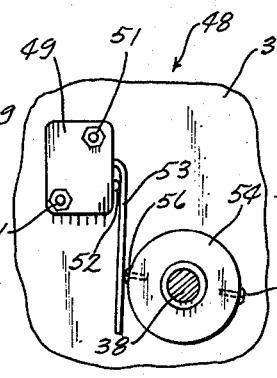
FIG. 7 is a fragmentary end elevational view taken along line 7—7 of FIG. 2.

The switch mechanism 48, most clearly depicted in FIG. 7, is interposed in the electric circuit for the motor 44 and has a switch 49 affixed by bolts to the end wall 34 at 51. A plunger 52 and a curved leaf contact 53 project outwardly from one side of the switch 49. The leaf contact 53 projects further than the plunger 52 and curves over the plunger 52, into a parallel relationship with the side of the switch 49, and into a position proximate the drive rod 38. A collar 54, having diametrically opposed sockets with switch actuators 56 removably secured therein, centrally receives the drive rod 38.

The leaf 53 normally does not contact the plunger 52. When a consumer inserts the appropriate coinage into the coin-mechanism, The electric motor 44 is actuated. The gear reduction unit 46, the rod 38 and therefore the helix 28 are driven by the motor 44. The rotation of the drive rod 38 brings a switch actuator 56 into contact with the leaf 53. The leaf 53 is thereby made to press against the plunger 52 which causes the switch 49 to break the circuit of the motor 44 and thereby to shut the motor 44 off. Two switch actuators 56 disposed in the collar 54 as illustrated in FIG. 7 permit a 180° rotation of the helix 28 upon each actuation of the drive device 29. One item 31 or 32 is advanced forward and guided into the discharge chute 24 by the ejector mechanism 43 upon each 180° rotation of the helix 28.

The central divider plate 30 of each item discharge unit 26 (FIGS. 2, 3, and 4) is elongated and substantially rectangular in shape and has rounded longitudinal edges 57. The plate 30 has a front portion 83 having vertical slots 84 formed therethrough. The plate 30 rotatably receives the drive rod 38 by means of brackets 58 and is affixed to the end wall 34 by means of rear flanges 59 and bolts. The plate 30 is vertically disposed and extends the length of the helix 28 and within the helix 28. The helix 28 rests upon the divider plate 30.

Figure 5:
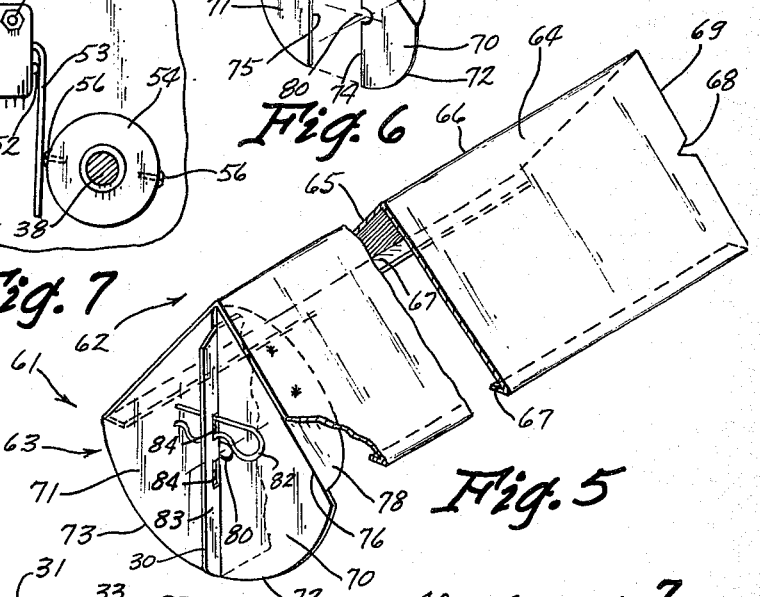
FIG. 5 is a foreshortened, partially cut away, perspective view of the filler assembly of this invention.

The improvement to the above described helical coil vending machine 21 is a detachable filler assembly 61 depicted most clearly in FIG. 5. The filler assembly 61 includes a top member 62 and a front end member 63. The top member 62 is elongated and of an inverted V shape in cross section. The top member 62 includes a first side member 64 and a second side member 65 which join together to form a ridge 66. The first side member 64 depends to the right from the ridge 66 when viewed in front elevation, and the second side member 65 depends to the left. The members 64, 65 terminate away from the ridge 66 in lower depending edges 67. The first member 64 has a greater dimension between its lower depending edge 67 and the ridge 66 than does the second member 65. A notch 68 is formed in the rear edge 69 of the first side 64.

Figure 6:
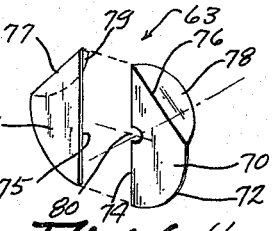
FIG. 6 is a reduced, exploded view of the front member of the filler assembly of this invention.

The front end member 63, more clearly depicted in FIG. 6, has a right portion 70 and a left portion 71. The portions 70, 71 are basically triangular in shape, having lower arcuate edges 72, 73, inner vertically disposed edges 74, 75 and upper angularly disposed edges 76, 77. Tabs 78, 79 are joined perpendicularly to the portions 70, 71 along the upper edges 76, 77. A notch 80 is formed in the vertical edge 74 of the right portion 70.

The front end member 63 is attached to the top member 62 by affixing the tabs 78, 79 to the undersides of the first and second sides 64, 65 by such means as spot welding. The vertical edges 74, 75 of the portions 70, 71 are proximately disposed when the front end 63 is affixed to the top member 62.

The filler assembly 61, as is shown in FIGS. 2 and 3, fits within the space enclosed by the helix member 28. The ridge portion 66 rests upon the upper rounded longitudinal edge 57 of the central divider plate 30. The convolutions 40 of the helix 28 rest upon the ridge 66, and the drive rod 38 of the helix 28 passes through the notch 80 formed in the front end member 63. The edges 74, 75 come together against opposite sides of the front portion 83, the slots 84 being disposed above and below the notch 80. The notch 68 is engaged by a projection 81 from the end wall 34. A cotter pin 82 is attached to the central divider plate 30, being received through one of the slots 84, immediately in front of the filler assembly 61 to prevent the assembly 61 from sliding forward along the rod 38 and out of engagement with the projection 81.

When in use the filler assembly 61, as best depicted in FIGS. 3 and 4, fills and reduces the space available, between the central divider plate 30 and the sides 33 of the tray 27 and within the convolutions 40 of the helix 28, for storage of items to be vended. Upper spaces which are triangular in cross section are formed between the sides 64, 65 and the respective walls 33. The upper portions of the convolutions 40 intersect the spaces formed by the filler assembly 61. The gum and mint packages 31, 32 desired to be vended fit securely in the spaces formed by the filler assembly, each item resting upon either the first or second side 64 or 65, against a side wall 33 and between consecutive convolutions 40.

The preferred embodiment disclosed herein depicts, in FIGS. 3 and 4, the first and second sides 64, 65 as meeting at the ridge 66 at a 90° angle. Most gum and mint packages 31, 32 can be satisfactorily vended with the filler assembly 61 thus formed. For such packages having an unusually small width, a filler assembly 61 having sides 64, 65 meeting at an angle greater than 90° may be used to further reduce the space within the helix 28, thereby assuring that the packages are properly held between the convolutions 40.

The lower depending edge 67 of second side member 65 is closer to a wall 33 than the edge 67 of the first side member 64. The central divider plate 30 is disposed to one side of the drive rod 38 and is closer to the side wall 33 proximate the lower edge 67 of the second side 65. The packages 31 in FIGS. 3 and 4 are thereby held in a space-saving, overlapping fashion. The greater dimension of side 64 fully supports a package 31; whereas the lesser dimension of side 65 is sufficient to support a package 31 since partial support is provided by the package 31 resting upon side 64. A greater overlapping could be obtained by arranging the helix 28 and drive device 29 in such a manner that the drive rod 38 would be disposed closer to the side wall 33 adjacent the lower edge 67 of second side 65.

The rotation of the helix 28 results in the movement of the items 31, 32 by the convolutions 40 over the side members 64, 65 to the discharge chute 24. When an item 31 or 32 has been pushed off the top member 62 of the filler assembly 61 by the convolutions 40, the ejector member 43 affixed to the helix 28 is rotated into the item 31 or 32 and pushes and guides the item 31 or 32 into the discharge chute 24.

The slope of the sides 64, 65 facilitate the loading of the vending machine 21. The vending machine 21 has also been adapted to vend items of less than standard cigarette package size, such as gum or mint packages 31 or 32, by a filler assembly 61 of simple and economical construction. Thus the objects of this invention have been achieved.

Although a preferred embodiment has been disclosed herein, it is to be remembered that various modifications and alternate constructions can be made thereto without departing from the full scope of the invention, as defined in the appended claims.

We claim:

1. In a vending machine having a cabinet and within one portion of which is an item discharge chute for dispensing items to be withdrawn from the machine, a plurality of item discharge units mounted in a side-by-side, horizontally disposed arrangement, each item discharge unit having a tray and a motor-driven helix member disposed therein, each item discharge unit further having a vertically disposed central divider plate extending within and along the length of the helix member, individual standard sized items being held in pairs between consecutive convolutions of the helix member, the items of each pair being on opposite sides of the central divider plate, and moved toward the discharge chute by rotation of the helix member, wherein the improvement comprises:

means for filling and reducing the spaces between the central divider plate and the walls of the tray in an angular fashion so that spaces triangular in cross section are formed which are intersected by the upper portions of the consecutive convolutions of the helix whereby items of less than standard size in horizontal and vertical dimensions are held between the consecutive convolutions and the walls of the tray in angular relationship to the walls of the tray;

said means for filling and reducing including a top member and a front member, said top member having first and second side members, said first and second side members along one edge being contiguous to form a ridge, said first and second side members depending from said ridge to terminate in lower depending edges, said ridge resting against and upon the central divider plate, said side members sloping downwardly from said ridge on opposite sides of the central divider plate at an angle away from the central divider plate and toward the walls of the tray, said front member affixed to the end of said top member adjacent the discharge chute, the helix resting upon said ridge and passing through said front member.

2. An improvement to a vending machine as defined in claim 1 and further wherein the dimension between said ridge and said lower depending edge of said first side member is greater than the dimension between said ridge and said lower depending edge of said second side member.

3. An improvement to a vending machine as defined in claim 1 and further wherein said lower depending edge of said second side member is closer to a wall of the tray than is said lower depending edge of said first side member.

4. An improvement to a vending machine as defined in claim 1 and further wherein said first side member has a notch formed in the end opposite the end of attachment of said front member, the tray having a projection extending therefrom, said notch being engaged by the projection.

5. An improvement to a vending machine as defined in claim 1 and further wherein an ejector member is affixed to the helix immediately forward of said front member, said ejector member being triangular in shape and being affixed to the most forwardly disposed of the consecutive convolutions, said ejector member along one side thereof being attached to the first quarter portion of the most forwardly disposed convolution, said ejector member being disposed at an angle to the vertical and having a slanting surface facing into the space enclosed by the helix, said ejector member being engageable with the most forwardly advanced item of less than standard size, said slanting surface guiding the item upon rotation of the helix from said top member into the discharge chute.

* * * * *